United States Patent [19]

Anttila

[11] Patent Number: 4,618,908

[45] Date of Patent: Oct. 21, 1986

[54] INJECTOR DRIVER CONTROL UNIT WITH INTERNAL OVERVOLTAGE PROTECTION

[75] Inventor: Dennis A. Anttila, Coconut Creek, Fla.

[73] Assignee: Motorola, Inc., Schaumburg, Ill.

[21] Appl. No.: 762,467

[22] Filed: Aug. 5, 1985

[51] Int. Cl.[4] ..... F02D 41/30; H01H 47/32

[52] U.S. Cl. ..... 361/187; 123/490

[58] Field of Search ..... 361/187; 123/490

[56] References Cited

U.S. PATENT DOCUMENTS 4,417,201 11/1983 Reddy ..... 123/490

4,511,945 4/1985 Nielsen ..... 123/490

*Primary Examiner*—Michael L. Gellner

*Attorney, Agent, or Firm*—Steven G. Parmelee

[57] ABSTRACT

An injector driver control unit with internal overvoltage protection. The device includes a first overvoltage sense unit (18) and an injector drive inhibit unit (21) for diverting injector drive signals from an injector drive unit (14) and for diverting flyback energy from a flyback control unit (16). The device also includes a second overvoltage sense unit (19) that can control a clamp control unit (22) to thereby activate an energy clamp (23) to control voltage potential across the injector solenoid (12).

14 Claims, 4 Drawing Figures

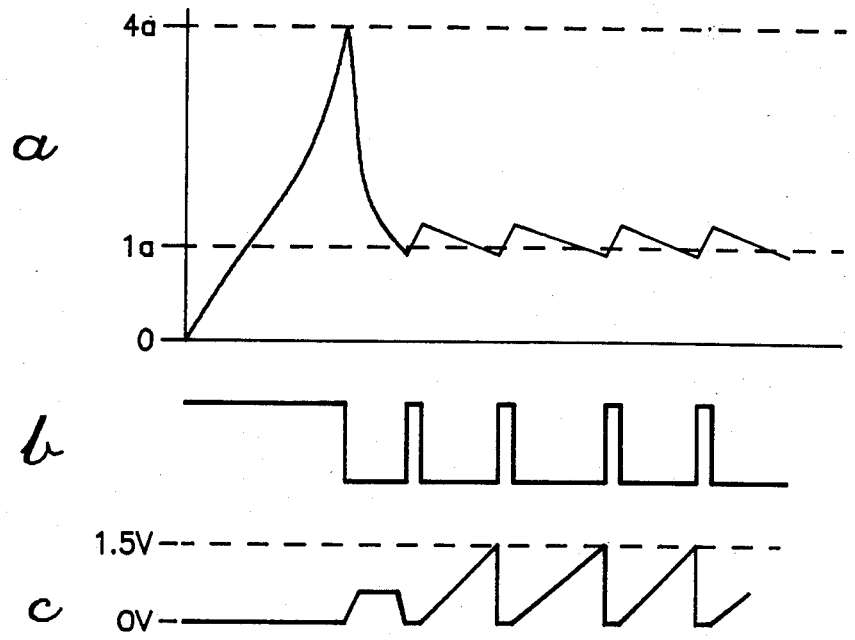
Fig. 3
Fig. 4
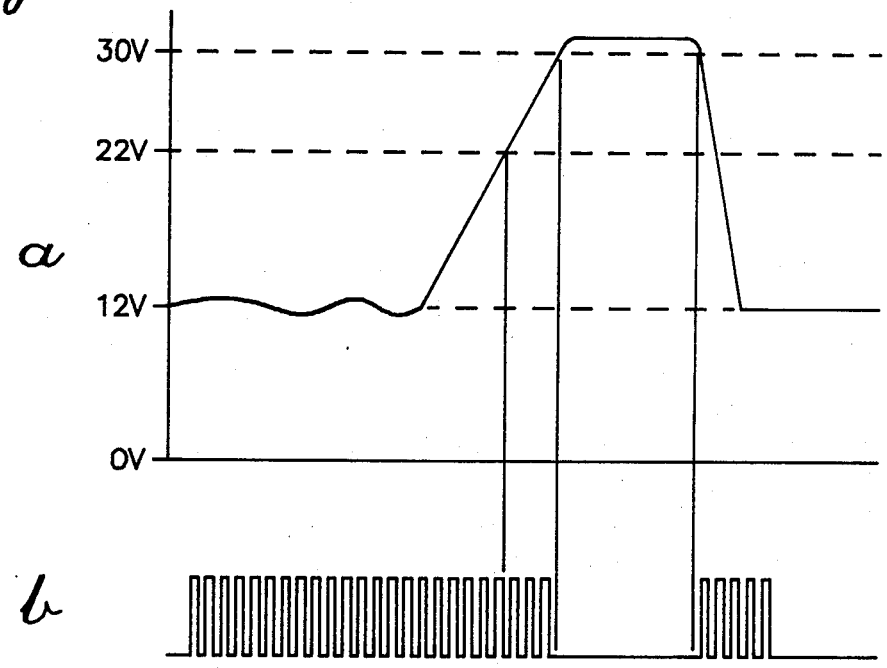

INJECTOR DRIVER CONTROL UNIT WITH INTERNAL OVERVOLTAGE PROTECTION

TECHNICAL FIELD

This invention relates generally to electronic fuel injection systems.

BACKGROUND ART

Many internal combustion engines utilize fuel injectors to introduce combustible fluids into the combustion chambers of the engine. Electronic controls are generally utilized to govern operation of the fuel injectors. To allow appropriate interaction between the injector valve structure and the electronic controls, such injectors typically include a solenoid operated valve that can respond to electric signals from the electronic controls.

The electronic controls for such prior art fuel injector systems typically include a current sense unit that can provide a signal indicative of the level of current flowing through the injector solenoid. An injector drive control unit receives these signals and determines when the injector solenoid should be opened or closed. The injector drive control unit can then apply a drive signal when appropriate to an injector drive unit. The injector drive unit will selectively allow current to flow from a power source (such as a battery) through the injector solenoid and the injector drive unit.

Such prior art systems also usually include a flyback control unit. Although current flow through an inductor cannot be halted in an instant, the flyback control unit provides a means for the stored energy in the solenoid coil to be quickly dissipated and thereby assure a speedy response of the injector valve itself.

In an automotive environment, the power source usually comprises a battery. Occasionally, high voltage transients can be expected on the power bus of the automobile. Such high voltage transients can greatly disturb the proper operation of an electronically controlled fuel injection system.

To avoid the impact of such transients, many prior art systems provide transient suppressers that are intended to suppress the transient before it can get to the electronic controls or the injector solenoid. This does not represent a completely satisfactory solution, since the injector solenoid itself will often be connected directly to the battery, and the external transient suppression protection offered by the prior art may not always suffice to adequately protect the system.

On the other hand, providing additional transient protection to an electronic fuel injection control system poses other problems. Such control systems are typically small, and increasing their size to accomodate additional transient protection usually constitutes an unacceptable design alternative.

There therefore exists a need for a transient protection mechanism that will operate to adequately protect an electronically controlled fuel injection system without requiring an unacceptable redesign of the electronic controls themselves.

SUMMARY OF THE INVENTION

These needs and others are substantially met through provision of the injector driver control unit with internal overvoltage protection as described in this specification. The device generally includes a current sense unit, an injector drive unit, a flyback control unit, and an injector drive control unit. The device further includes a first overvoltage sense unit, a second overvoltage sense unit, an injector drive inhibit unit, an energy clamp, and a clamp control unit.

The current sense unit senses current flowing through the injector solenoid and provides a current sense signal in proportional response thereto. The injector drive unit responds to a drive signal to allow current to flow through the injector solenoid from a power source, such as a battery. The flyback control unit connects to the injector solenoid and to the injector drive unit and serves to cause energy in the injector solenoid to become quickly dissipated when the injector drive unit has been switched off. The injector drive control unit responds to an input control signal and the current sense signal to provide drive signals to the injector drive unit as appropriate.

The first overvoltage sense unit connects to the power source and serves to detect certain overvoltage conditions. Upon detecting such an overvoltage condition, the first overvoltage sense unit provides an overvoltage detected signal. Much the same can be said with respect to the second overvoltage sense unit, with the exception that the second overvoltage sense unit may detect a different level of overvoltage condition than the first overvoltage sense unit.

The injector drive inhibit unit responds to the first overvoltage sense unit, and upon receiving an overvoltage detected signal from the first overvoltage sense unit, the injector drive inhibit unit will inhibit the drive signal from the injector drive control unit from causing the injector drive unit to allow current flow through the injector solenoid, thereby effectively disabling the injector drive unit even though a drive signal might be present at the time of sensing the overvoltage condition.

The energy clamp connects to the power source and to the injector solenoid and responds to a clamp control signal to prevent more than a preselected voltage potential from developing across the injector solenoid. The clamp control unit responds to the overvoltage detected signal from the second overvoltage sense unit, and, upon receiving such a signal, provides the clamp control signal to the energy clamp to cause the energy clamp to operate as described above.

In one embodiment of the invention, the injector drive inhibit unit inhibits the drive signal by diverting the drive signal from the injector drive unit to ground. Furthermore, the injector drive inhibit unit can operate to divert flyback energy to ground through the flyback control unit during an overvoltage condition, thereby assuring that the injector drive unit will remain completely inhibited.

Through use of this device, an injector driver control unit can be provided that requires no more space than current state of the art units. In fact, the device can be dedicated to integrated circuit form and yet still retain the integral overvoltage protection provided through use of the device. The overvoltage protection provided offers superior overvoltage protection in comparison to prior art techniques described above.

BRIEF DESCRIPTION OF THE DRAWINGS

These and other attributes of the invention will become more clear upon making a thorough review and study of the following description of the best mode for carrying out the invention, particularly when reviewed in conjunction with the drawings, wherein:

FIG. 3 comprises three waveform diagrams; and

FIG. 4 comprises two waveform diagrams.

BEST MODE FOR CARRYING OUT THE INVENTION

Figure 1:
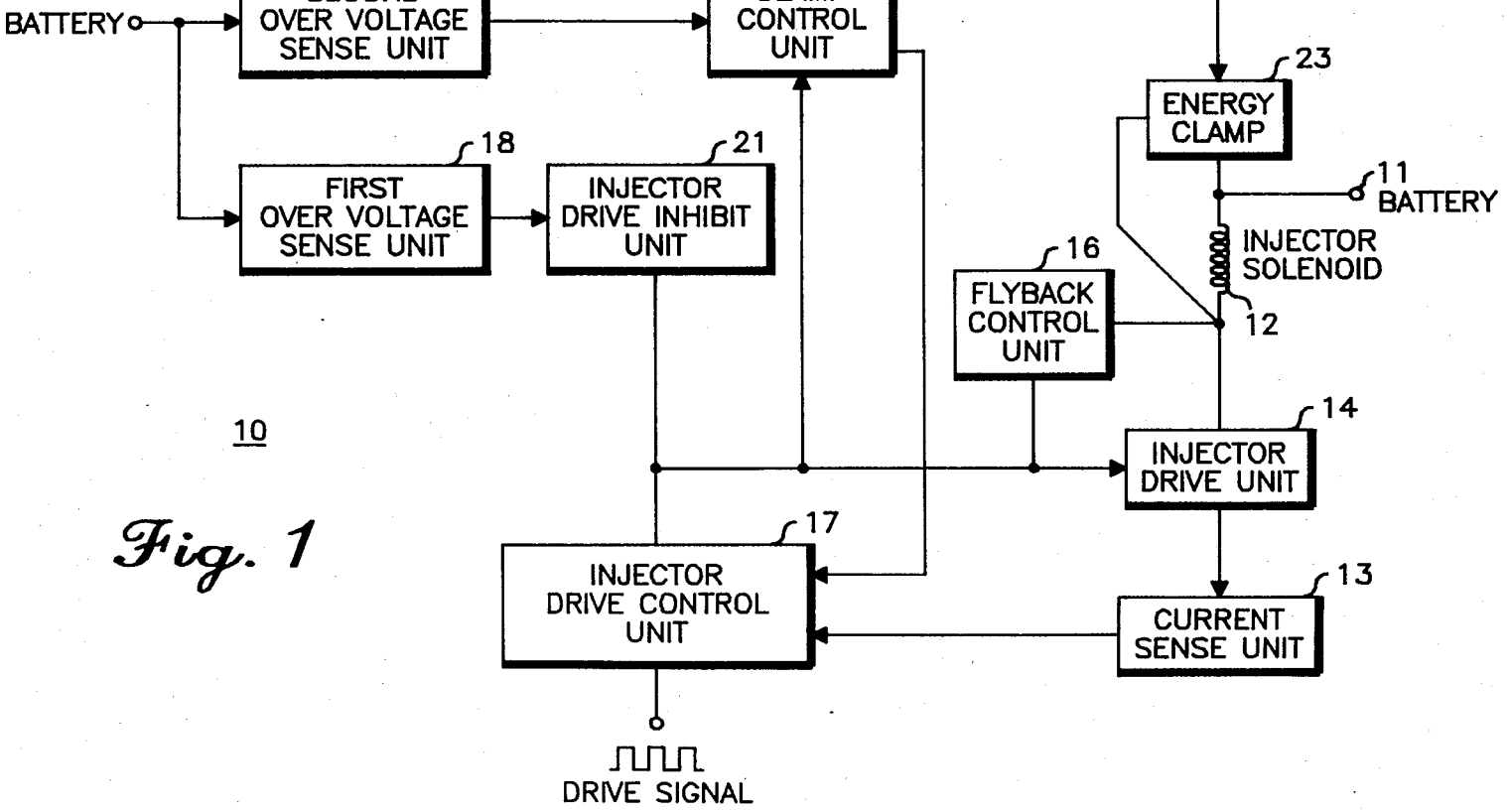
FIG. 1 comprises a block diagram depiction of the injector driver control unit with transient protection.

Referring now to the drawings, and in particular to FIG. 1, the device as configured in conjunction with an injector driver control unit can be generally seen as denoted by the reference numeral 10. The device (10) operates in conjunction with a power source (11) such as a 12 volt battery and an injector solenoid (12), both being well known in the art.

The injector driver control unit includes a current sense unit (13), an injector drive unit (14), a flyback control unit (16), and an injector drive control unit (17). The device (10) may be comprised of a first overvoltage sense unit (18), a second overvoltage sense unit (19), an injector drive inhibit unit (21), a clamp control unit (22), and an energy clamp (23). Each of these generally referred to components will now be described in more detail in seriatim fashion.

Figure 2:
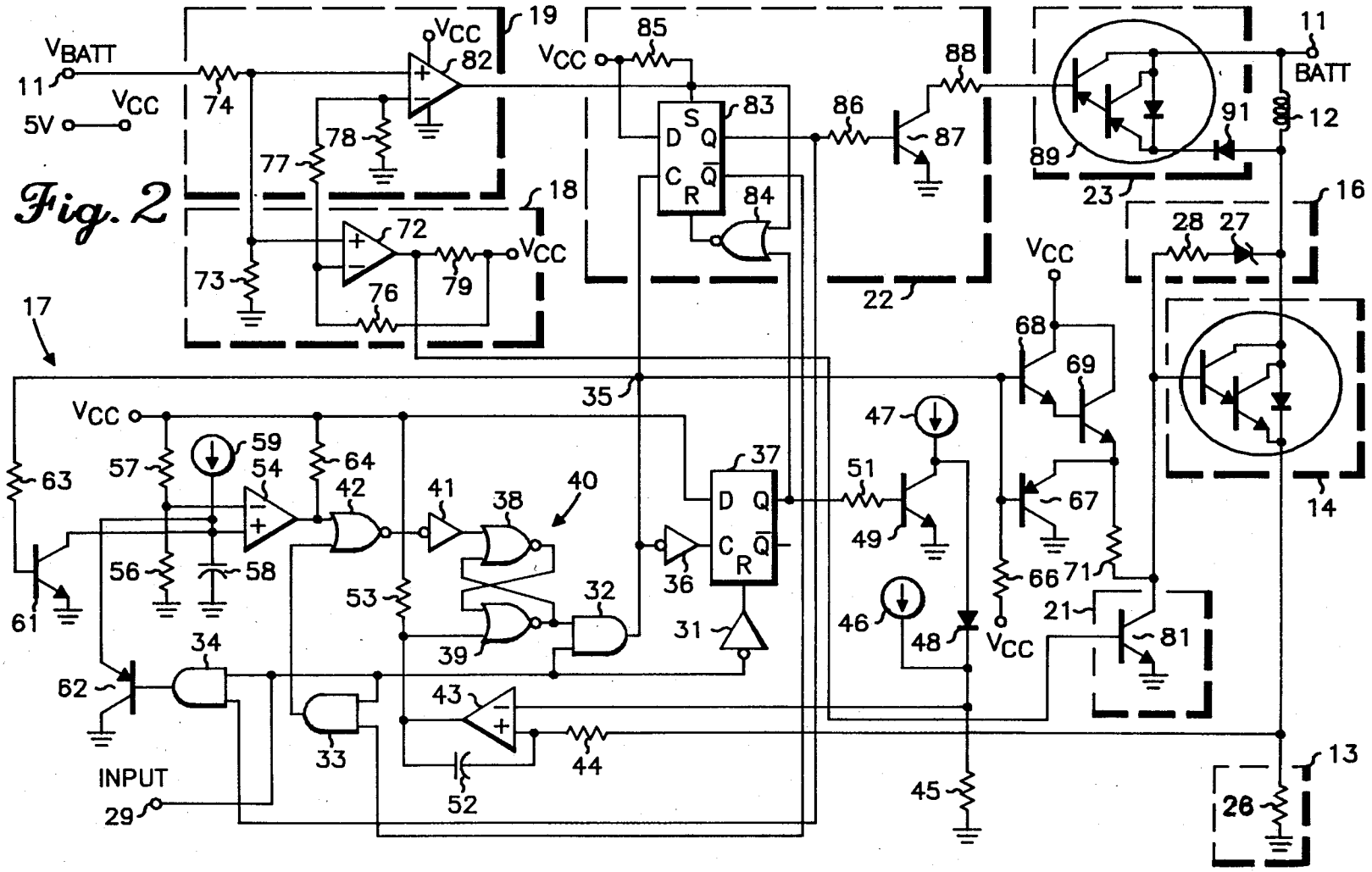
FIG. 2 comprises a schematic diagram of the invention in conjunction with an injector driver control unit.

Referring now to FIG. 2, the injector solenoid (12) connects to the power source (11) and to the injector drive unit (14). In this particular embodiment, the injector drive unit can be a switch comprised of a TIP101 component that comprises two transistors and a diode.

The injector drive unit (14) in turn connects in series with a 0.1 ohm resistor (26) that comprises the current sense unit (14). A 33 volt Zener diode (27) and a 200 ohm resistor (28) are connected in series between the base drive of the injector drive unit (14) and the injector solenoid (12). This Zener diode and resistor (27 and 28) comprise the flyback control unit (16). It will be appreciated that when the injector drive unit (14) suddenly stops conducting due to a lack of base drive, the potential at the node connecting the injector solenoid (12) to the Zener diode (27) will increase positively. This will cause the Zener diode (27) to break down and apply base drive to the injector drive unit (14). The injector drive unit (14) will be switched on in an active operating range to thereby cause any energy stored in the injector solenoid (12) to quickly dissipate.

With continued reference to FIG. 2, the injector drive control unit (17) will now be described.

Input control signals are received at an input port (29). The input port (29) connects to a first inverter (31) and to one input each of a first AND gate (32), a second AND gate (33), and a third AND gate (34). The output of the first inverter (31) conects to the reset port of a first flip-flop (as provided through use of an MC14013). The output of the first AND gate (32) connects to a drive signal line (35) and through a second inverter (36) to the clock input of the first flip-flop (37). The data port of the flip-flop (37) connects to a $V_{cc}$ source, and the Q output connects as described in more detail below.

The remaining input of the first AND gate (32) connects to the $\overline{Q}$ output of a latch (40) comprised of two NOR gates (38 and 39). The reset input of the latch (40) connects to a comparator (43) as described below and the set input connects to a third NOR gate (42) through a third inverter (41). One input of the third NOR gate (42) connects to the output of the second AND gate (33), and the remaining input connects to a delay unit comparator (54) as described in more detail below.

A first comparator (43) (as provided through use of an LM2901) has a non-inverting input that connects through a 10 k ohm resistor (44) to the current sense unit resistor (26). The inverting input of this comparator (43) connects to a grounded 10 k ohm resistor (45) and to a switchable current source network comprising a 10 microampere source (46) and a 30 microampere source (47) (such current sources are well known in the art and hence no more detailed description of such sources need be provided here). A diode (48) connects to the output of both sources, and the collector of a transistor (49) (as provided through use of a 2N4401) connects to the output of the 30 microampere source (47). The base of this transistor (49) connects through a 10 k ohm resistor (51) to the Q output of the first flip-flop (37).

A 100 picofarad capacitor (52) connects between the output of the first comparator (43) and the noninverting input thereof. The output of the first comparator (43) connects to a 5 k ohm pull-up resistor (53) and to the reset input of the latch (40).

A second comparator (54) comprises a part of a delay unit. The inverting input to this second comparator (54) connects between a grounded 1.5 k ohm resistor (56) and a 3.5 k ohm resistor (57) that connects to a $V_{cc}$ source. The non-inverting input of the second comparator (54) connects: (a) to a grounded 0.01 microfarad capacitor (58); (b) to the output of a 500 microampere currect source (59); (c) to the collector of an NPN transistor (61) (such as a 2N4401); and (d) to the emitter of a PNP transistor (62) (such as a 2N4403).

The emitter of the NPN transistor (61) connects to ground, and the base connects through a 10 k ohm resistor (63) to the drive signal line (35). The collector of the PNP transistor (62) connects to ground, and the base connects to the output of the third AND gate (34). The output of the delay comparator (54) connects to a 10 k ohm pullup resistor (64) and to one input of the third NOR gate (42) referred to above.

In addition to the connections noted above, the drive signal line (35) also connects: (a) to a 5 k ohm pull-up resistor (66); (b) to the base of a PNP transistor (67) (such as a 2N4403); and (c) to the base of an NPN transistor (68) (such as a 2N4401). The collector of the PNP transistor (67) connects to ground. The collector of the NPN transistor (68) conects to a $V_{cc}$ source and the emitter connects to the base of another NPN transistor (69) (such as a 2N4401). The collector of the second NPN transistor (69) connects to a $V_{cc}$ source and the emitter connects to the emitter of the PNP transistor (67) and through a 200 ohm resistor (71) to the injector drive inhibit unit (21) and to the base drive input of the injector drive unit (14).

With continued reference to FIG. 2, the first overvoltage sense unit (18) will now be described.

A third comparator (72) (as provided through use of an LM2901) has a non-inverting input connects through a voltage divider network comprising a grounded 2 k ohm resistor (73) and a 20 k ohm resistor (74) to the power source (11). The inverting input connects to a reference voltage network comprising an 11 k ohm resistor (76) that connects to a $V_{cc}$ source, a 3.2 k ohm resistor (77), and a grounded 10 k ohm resistor (78). The output of the third comparator (72) connects to a 5 k ohm pull-up resistor (79) and to the injector drive inhibit unit (21).

The injector drive inhibit unit (21) comprises a transistor (81) (such as a 2N4401) having its base coupled to the output of the first overvoltage sense unit comparator (72), its emitter coupled to ground, and its collector coupled to the input of the injector drive unit (14).

A fourth comparator (82) (as provided through use of an LM2901) comprises the second overvoltage sense unit (19). The inputs of this comparator (82) connect to the same voltage divider network and reference voltage network as does the third comparator (72). The output of the fourth comparator (82) connects: (a) to a 10 k ohm pull-up resistor (85); (b) to the set input of a second flip/flop (83) (as provided through use of an MC14013); and (c) to one input of a fourth NOR gate (84).

The flip/flop (83) and the NOR gate (84) are both a part of the clamp control unit (22). The remaining input to the NOR gate (84) connects to the Q output of the injector drive control unit flip/flop (37) described below. The output of the NOR gate (84) connects to the reset port of the second flip/flop (83). The clock input of this flip/flop (83) connects to the drive signal line (35). The data input connects to a $V_{cc}$ source. The $\overline{Q}$ output connects to the remaining input of the second AND gate (33) described above. The Q output connects to the remaining input of the third AND gate (34) described above, and through a 10 k ohm resistor (86) to the base of a transistor (87) (such as a 2N4401). The emitter of this transistor (87) connects to ground and the collector connects through a 5 k ohm resistor (88) to the energy clamp (23).

The energy clamp (23) comprises a TIP106 component (89) that essentially comprises two PNP transistors configured with a diode. The energy clamp (23) also includes a diode (91) coupled between the TIP106 (89) and the solenoid injector (12).

Operation of the invention can now be described.

In the absence of an input signal (as applied to the input port (29)), a low signal will be provided to one input each of the first, second, and third AND gates (32, 33, and 34) of the injector drive control unit (17). This low signal will also be inverted through the first inverter (31) to provide a reset signal to the first flip/flop (37). As a result of the above, a low signal will be present on the drive signal line (35), thereby maintaining the injector drive unit (14) switched off.

In the absence of an overvoltage condition, the outputs of both the first and second overvoltage sense units (18 and 19) will be low. Therefore, the injector drive inhibit unit transistor (81) will be biased off and the second flip/flop (83) will be held in reset, thereby maintaining the energy clamp (23) in an off state as well. It may also be appropriate at this point to note that the PNP transistor (62) associated with the second comparator (54) in the injector drive control unit (17) will be on, thereby preventing the capacitor (58) connected to the noninverting input of the second comparator (54) from charging.

Upon receipt of an input signal at the input port (29), and presuming the absence of an overvoltage condition, a high signal will be applied to one input of the first, second, and third AND gates (32, 33, and 34). Further, the reset signal to the first flip/flop (37) will be removed, although the flip/flop (37) will not yet change output states.

As a result of this input signal, the first and second AND gates (32 and 33) will provide a high output, while the output of the third AND gate (34) will remain low, thereby keeping the PNP transistor (62) associated with the second comparator (54) switched on. With the output of the first AND gate (32) high, a high signal will appear on the drive signal line (35). As a result, the NPN transistor (61) associated with the second comparator (54) will be switched on, and the injector drive unit (14) will also be switched on to allow current to flow from the power source (11) through the injector solenoid (12), the injector drive unit (14), and the current sense unit resistor (26) to ground. It may be noted that, although the drive signal line is high, thereby applying a high signal to the clock input of the second flip/flop (83), the NOR gate (84) connected to the reset input thereof will continue to apply a reset signal thereto to maintain the flip/flop (83) in a reset state.

When the current flowing through the current sense unit resistor (26) equals 4 amperes, the output of the first comparator (43) will become high, thereby applying a reset signal to the latch (40). As a result of resetting this latch (40), one input to the first AND gate (32) will go low, thereby forcing a low output from the first AND gate (32). As a result of this low signal, the NPN transistor (61) associated with the second comparator (54) will be switched off (though the capacitor (58) will still be prevented from charging because the PNP transistor (62) remains on). The low signal on the drive signal line (35) will also switch off the injector drive unit (14). Finally, the low signal from the first AND gate (32) will be inverted through the second inverter (36) to provide a rising edge to the clock input of the first flip/flop (37), thereby causing a high signal to appear at the Q output.

This high signal will remove the reset signal from the second flip/flop (83) (although the flip/flop (83) will not change output states at this time) and will also switch on the transistor (49) connected to the current source network attached to the inverting input of the first comparator (43). In effect, this transistor (49) diverts the output of the 30 microampere source (47), leaving only the 10 microampere source (46) to bias the inverting input of the comparator (43). This changes the effective comparison threshold of the first comparator (43) from 4 amperes to 1 ampere.

With the injector drive unit (14) off, the monitored current will eventually decay to less than 1 ampere. When this occurs, the output of the first comparator (43) will go low, thereby removing the reset signal from the latch (40) and allowing a high signal to again be applied to the first AND gate (32). As a result, a high signal will appear on the drive signal line (35). This high signal will cause the injector drive unit (14) to again switch on and will also clock the second flip/flop (83), and provide a high signal at its Q output. This high signal on the Q output will cause the energy clamp (23) to switch on and will also cause a low output from the third AND gate (34), thereby switching off the PNP transistor (62) associated with the second comparator (54). This PNP transistor (62) will remain switched off and the energy clamp (23) will remain switched on for the remainder of the injection cycle.

With the injector drive unit (14) on, the monitored current will eventually exceed 1 ampere, causing the output of the first comparator (43) to become high and reset the latch (40). This will cause the output of the first AND gate (32) to become low and switch off the injector drive unit (14). This low signal from the drive signal line (35) will also cause the NPN transistor (61) associated with the second comparator (54) to switch off, thereby allowing the capacitor (58) to begin charging.

Until the capacitor (58) charges to 1.5 volts, the output of the second comparator (54) will be low, and the output state of the first AND gate (32) will not be altered, even though the monitored current may decay below 1 ampere. As soon as the capacitor (58) charges to 1.5 volts, however, the output of the second comparator (54) will become high and set the latch (40) to cause the first AND gate (32) to provide a high signal that will switch on the injector drive unit (14) and switch on the NPN transistor (61) associated with the second comparator (54) to discharge the capacitor (58) and ready it for another cycle.

With reference to FIG. 3, the voltage of the capacitor (58) will be as depicted in FIG. 3*c*. The signal appearing the drive signal line (35) will be as depicted in FIG. 3*b*, and the current flowing through the injector solenoid (12) will be as depicted in FIG. 3*a*. The current through the injector solenoid (12) will flucuate about the 1 ampere threshold after having attained a peak of 4 amperes initially. At the conclusion of the input signal as provided to the input port (29), the injector solenoid current will quickly decay through operation of the flyback control unit (16) in accordance with well understood operation.

Should an overvoltage condition occur, the second overvoltage sense unit (19) will provide a high output when the power source voltage equals or exceeds 22 volts. This high signal becomes applied to the NOR gate (84) of the clamp control unit (22) and removes the reset signal from the second flip/flop (83). At the same time, this high signal sets the flip/flop (83), thereby causing the energy clamp (23) to switch on and control the allowable voltage potential across the injector solenoid (12).

If the overvoltage condition equals or exceeds 30 volts (see FIG. 4*a*), then the output of the first overvoltage sense unit (18) will also switch high and bias on the transistor (81) of the injector drive inhibit unit (21). This will inhibit the drive signal (see FIG. 4*b*) to the injector drive unit (14) by diverting the injector drive signal away from the injector drive unit (14) and to ground. In addition, the injector drive unit (14) will be prevented from switching on even during flyback since the flyback current through the Zener diode (27) of the flyback control unit (16) will also be diverted to ground through the energy drive inhibit unit (21).

As a result of the above, the circuit provides overvoltage protection internally and supplementary to any external transient suppression techniques that may also be provided. These internal features could be easily provided in an integrated circuit design, therefore providing such features in a very compact form.

Those skilled in the art will recognize many variations and modifications that could be made with respect to the embodiment described that would not avoid the spirit of the invention. It should therefore be understood that the scope of the invention should not be considered as limited to the specific embodiments set forth, unless such limitations are clearly set forth in the claims.

I claim:

1. In an injector driver circuit for use with a fuel injector solenoid and a power source, said injector driver circuit comprising current sense means for sensing current flow through said injector solenoid and for providing a current sense signal in response thereto, injector drive control means for receiving an input signal and said current sense signal and for outputting a drive signal, and injector drive means responsive to said drive signal for selectively allowing current to flow from said power source through said injector solenoid and said injector drive means, an inprovement comprising:

(a) first overvoltage sense means operably connected to said power source for detecting overvoltage conditions and for providing an overvoltage detected signal in response to detecting such an overvoltage condition; and (b) injector drive inhibit means responsive to said overvoltage detected signal for inhibiting said drive signal from causing said injector drive means to allow current to flow from said power source through said injector solenoid and said injector drive means, such that injector solenoid current cannot flow through said injector drive means.

2. The improvement of claim 1 wherein said power source ordinarily provides power at a first voltage, and said first overvoltage sense means provides said overvoltage detected signal in response to power source voltages that at least equal a second voltage, said second voltage being different from said first voltage.

3. The improvement of claim 1 wherein said injector drive inhibit means inhibits said drive signal from causing said injector drive means to allow current to flow from said power source through said injector solenoid and said injector drive means, at least in part, by diverting said drive signal away from said injector drive means.

4. The improvement of claim 3 wherein said injector drive inhibit means diverts said drive signal to ground.

5. The improvement of claim 3 wherein said injector drive inhibit means comprises a switch.

6. The improvement of claim 5 wherein said switch includes a transistor having a conductive state that can be controlled in response to said overvoltage detected signal.

7. The improvement of claim 1 and further including:

(a) second overvoltage sense means operably connected to said power source for detecting overvoltage conditions and for providing a second overvoltage detected signal in response to detecting such an overvoltage condition;

(b) energy clamp means operably connected to said power source and to said injector solenoid and being responsive to a clamp control signal for preventing more that a preselected voltage potential from developing across said injector solenoid; and (c) clamp control means responsive to said second overvoltage detected signal for providing said clamp control signal to said energy clamp means.

8. The improvement of claim 7 wherein said power source ordinarily provides power at a first voltage, said first overvoltage sense means provides said overvoltage detected signal in response to power source voltages that at least equal a second voltage, and said second overvoltage sense means provides said second overvoltage detected signal in response to power source voltages that at least equal a third voltage, said third voltage being different from said first and second voltages.

9. The improvement of claim 8 wherein said first voltage is less than said third voltage, and said third voltage is less than said second voltage.

10. The improvement of claim 7 wherein said energy clamp means comprises a switch.

11. The improvement of claim 10 wherein said switch operably connects between said power source and said injector solenoid.

12. In an injector driver circuit for use with a fuel injector solenoid and a power source, said injector driver circuit comprising current sense means for sensing current flow through said injector solenoid and for providing a current sense signal in response thereto, switching injector control means for receiving an input signal and said current sense signal and for outputting a drive signal, injector drive means responsive to said drive signal for selectively allowing current to flow from said power source through said injector solenoid and said injector drive means, and flyback control means operably connected to said injector solenoid for facilitating rapid dissipation of flyback energy from said injector solenoid, an improvement comprising:

(a) first overvoltage sense means operably connected to said power source for detecting overvoltage conditions and for providing an overvoltage detected signal in response to detecting such an overvoltage condition; and (b) injector drive inhibit means responsive to said overvoltage detected signal for:

(i) inhibiting said drive signal from causing said injector drive means to allow current to flow from said power source through said injector solenoid and said injector drive means, such that injector solenoid current cannot flow through said injector drive means; and (ii) providing a path from said flyback control means to ground to allow said flyback energy to be diverted to ground.

13. The improvement of claim 12 wherein said injector drive inhibit means inhibits said drive signal from causing said injector drive means to allow current to flow from said power source through said injector solenoid and said injector drive means, at least in part, by diverting said drive signal to ground.

14. The improvement of claim 13 wherein said flyback control means comprises a Zener diode and said injector drive inhibit means comprises a transistor having a conductive state that can be controlled in response to said overvoltage detected signal.

* * * * *